United States Patent [19]

Henström

[11] 4,051,819

[45] Oct. 4, 1977

[54] ROTARY BLOCK ENGINE

[76] Inventor: Sten Henström, Mesangatan 2, 234 00 Lomma, Sweden

[21] Appl. No.: 669,750

[22] Filed: Mar. 24, 1976

[51] Int. Cl.[2] ..... F02B 57/10

[52] U.S. Cl. ..... 123/44 B; 123/44 D

[58] Field of Search ..... 123/44 B, 43 C, 44 D, 123/44 E

[56] References Cited

U.S. PATENT DOCUMENTS

| | | | |
|---|---|---|---|
| 1,068,297 | 7/1913 | Baird | 123/44 B |
| 1,526,610 | 2/1925 | Sellberg | 123/44 B |
| 3,835,823 | 9/1974 | Miller | 123/44 C |

*Primary Examiner*—Clarence R. Gordon
*Attorney, Agent, or Firm*—Hane, Sullivan & Spiecens

[57] ABSTRACT

A rotary-block engine is provided with an eccentrically mounted cylinder block about the main drive shaft. The radial cylinders of the cylinder block each contain a reciprocating piston which is also eccentrically mounted about a secondary shaft, so that a point on the piston traces a path in the form of a hypotrochoid while a point on the cylinder block traces a path in the form of an epitrochoid. The secondary shafts are held in place relative to the main shaft by projections engaging in grooves of the side walls of the stationary housing, or alternatively by holders rotatably mounted about the main shaft.

7 Claims, 5 Drawing Figures

ROTARY BLOCK ENGINE

The present invention relates to a rotary-block engine of the type which comprises a rotatable, rotation symmetrical cylinder block with a number of radial cylinders which, together with pistons arranged movably in said cylinders, form working chambers facing the centre of the engine, said cylinder block then being enclosed in an engine housing with parallel walls in which a main shaft is supported and the cylinder block being supported on an eccentric part of said main shaft.

By rotary-block engine is meant internal combustion engines, as well as compressors, pumps, and hydraulic motors.

Decades of continuous developments have produced a wide range of more or less sophisticated internal combustion engines of various types and sizes. The annual production is now many tens of millions of engines. The great majority of these engines work with one or several reciprocating pistons in fixed cylinders, which by means of wrist pins and piston rods transmit the gas pressure work to a rotating crankshaft. Although this type of engine has been developed into a reliable and comparatively cheap power converter, efforts are constantly being made to design more simple, lighter, more compact and more vibrationless engines. The greatest interest has been directed towards designs with rotating parts only, among which, however only the wankel engine has hitherto been subject to bulk production. In the designs hitherto proposed, it has not been possible to combine full balancing of the moving parts with simple and durable seals for the combustion chambers and the gas exchange systems.

The purpose of the present invention is to achieve an engine of the above-mentioned type which has great power density, full balancing and sealing of the work chamber with well-proven piston ring systems and surface seals with moderate sliding speeds. This is achieved according to the present invention by each of said pistons being supported on an eccentric part of a secondary shaft which is supported for planetary rotation around the main shaft at a constant radius with a speed in relation to the engine housing which is equal to the rotating speed of the main shaft divided by the number of cylinders.

Figure 1:
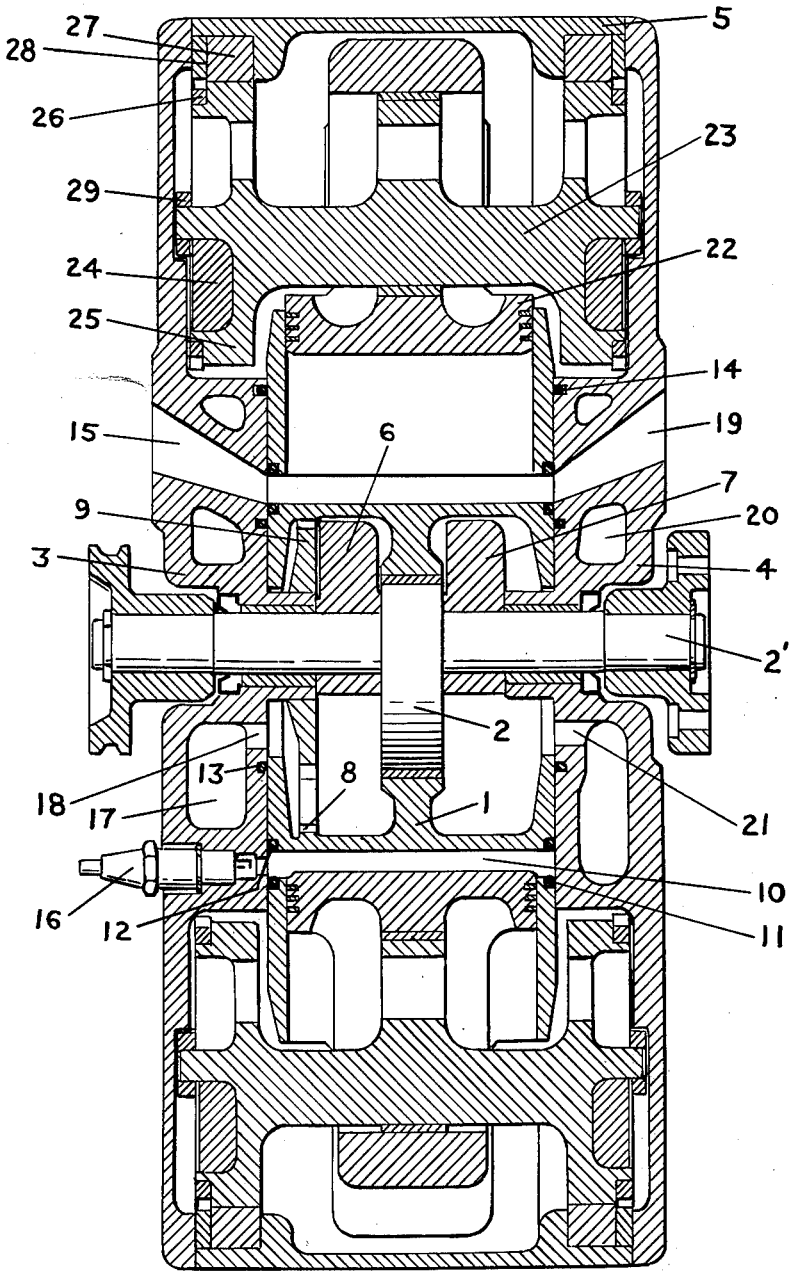
Figure 2:
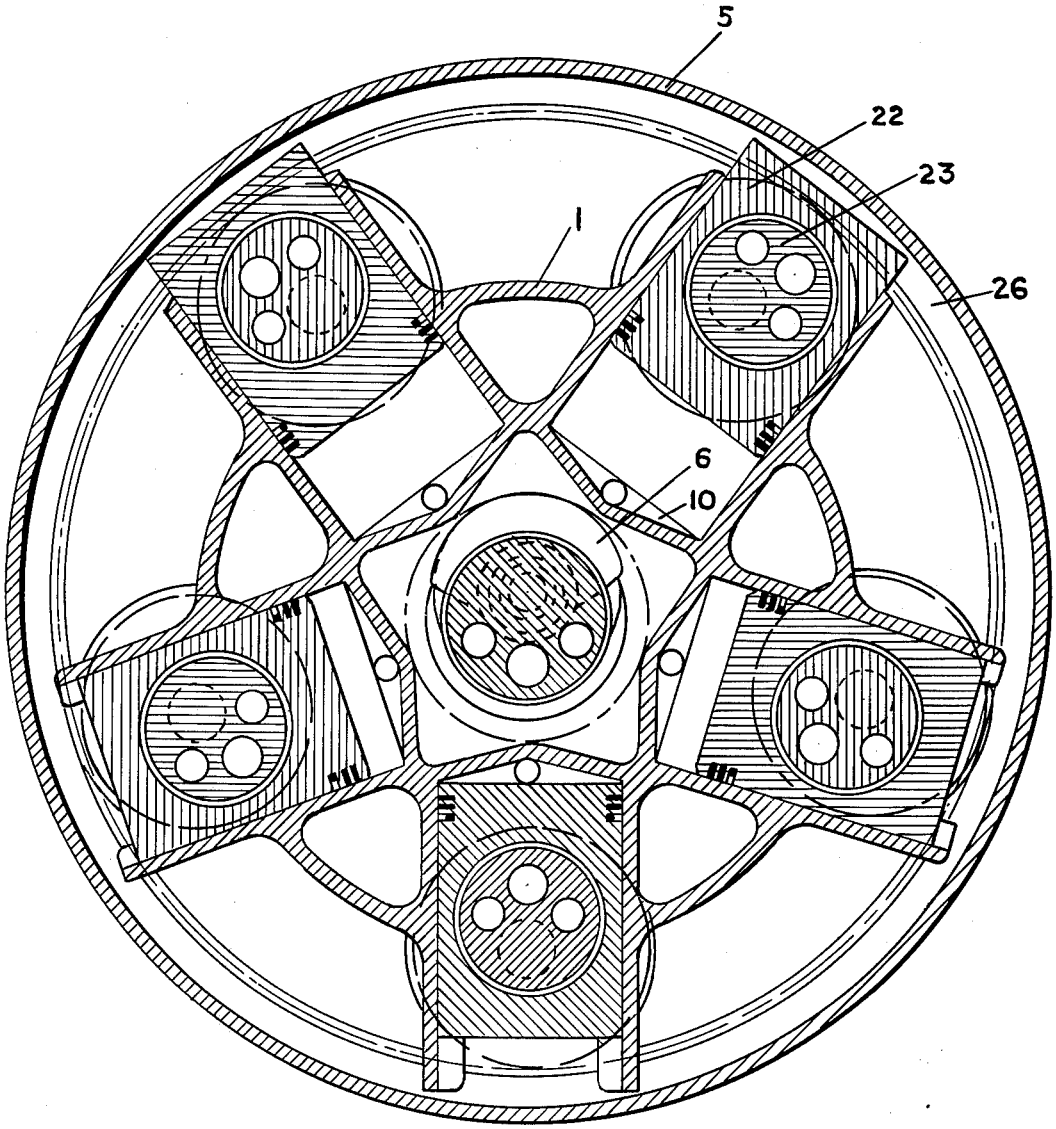
Figure 3:
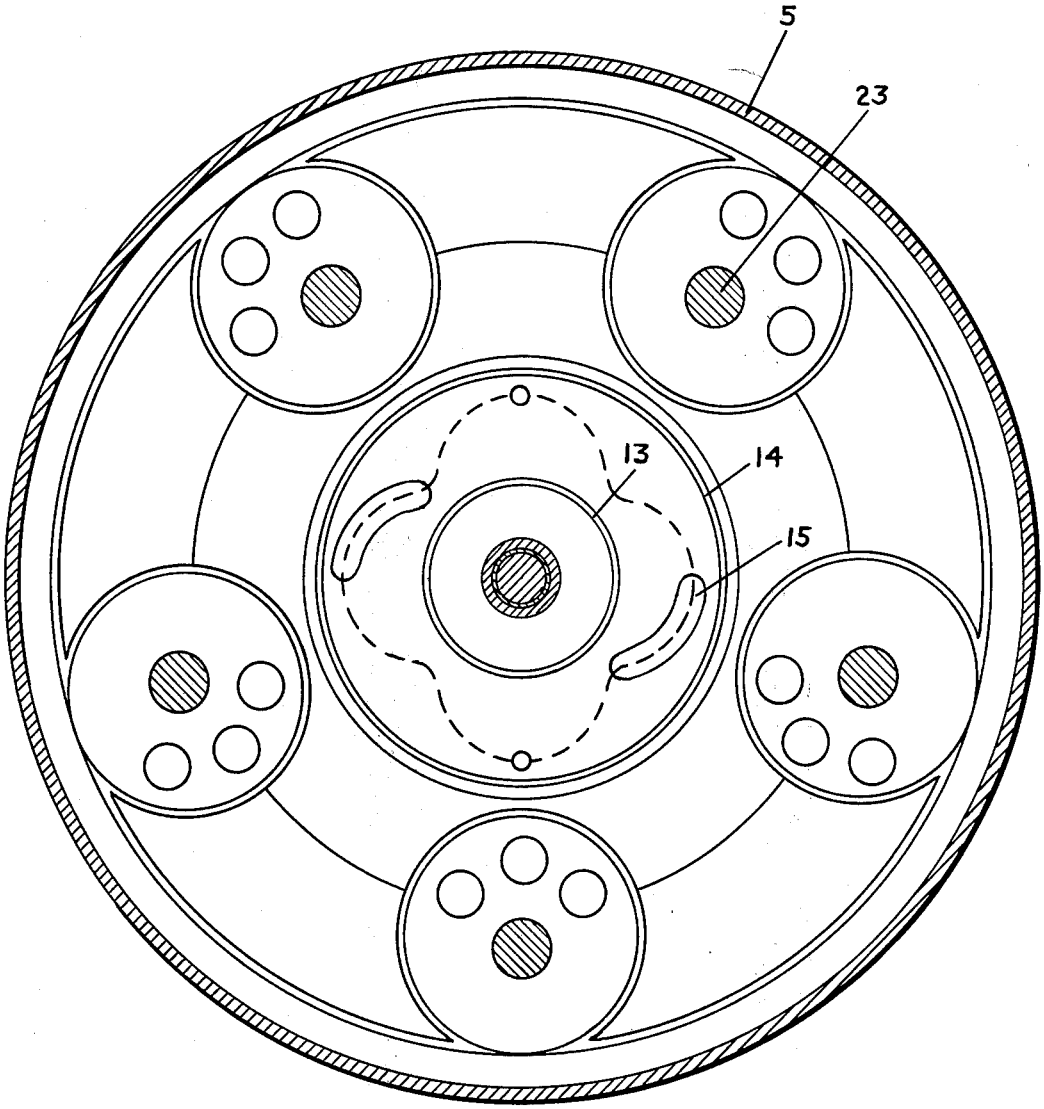
Figure 4:
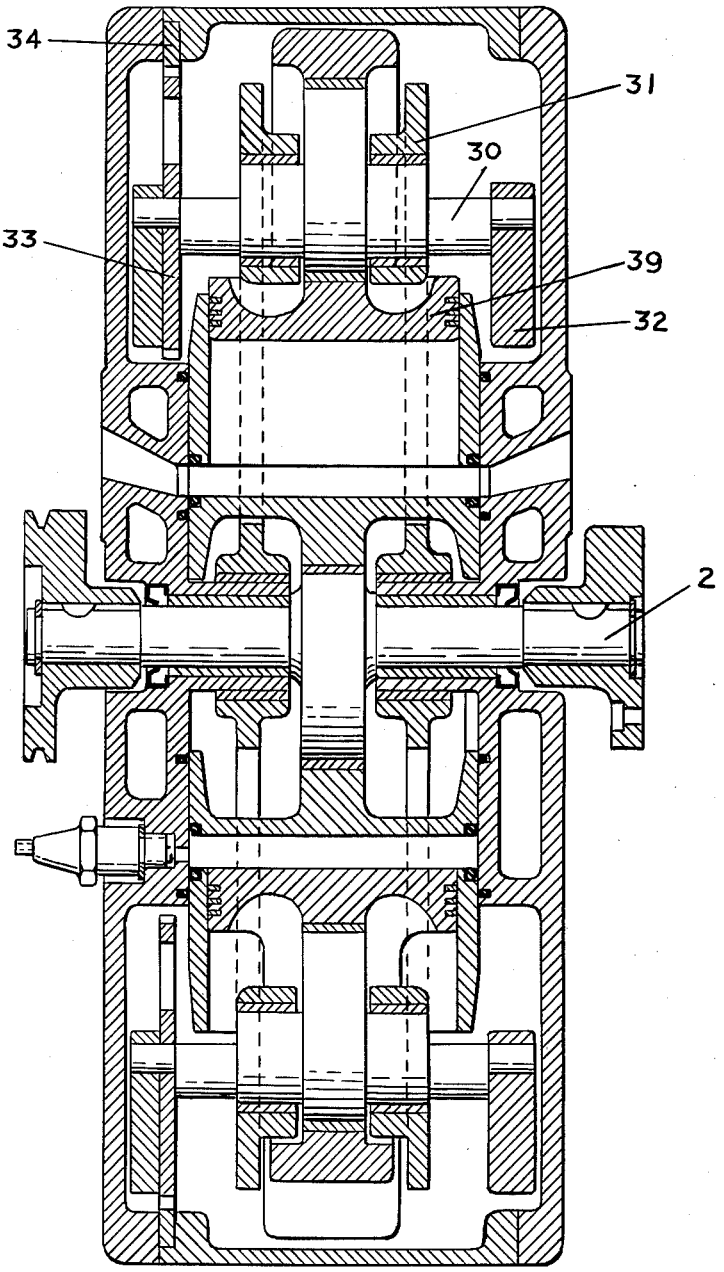
Figure 5:
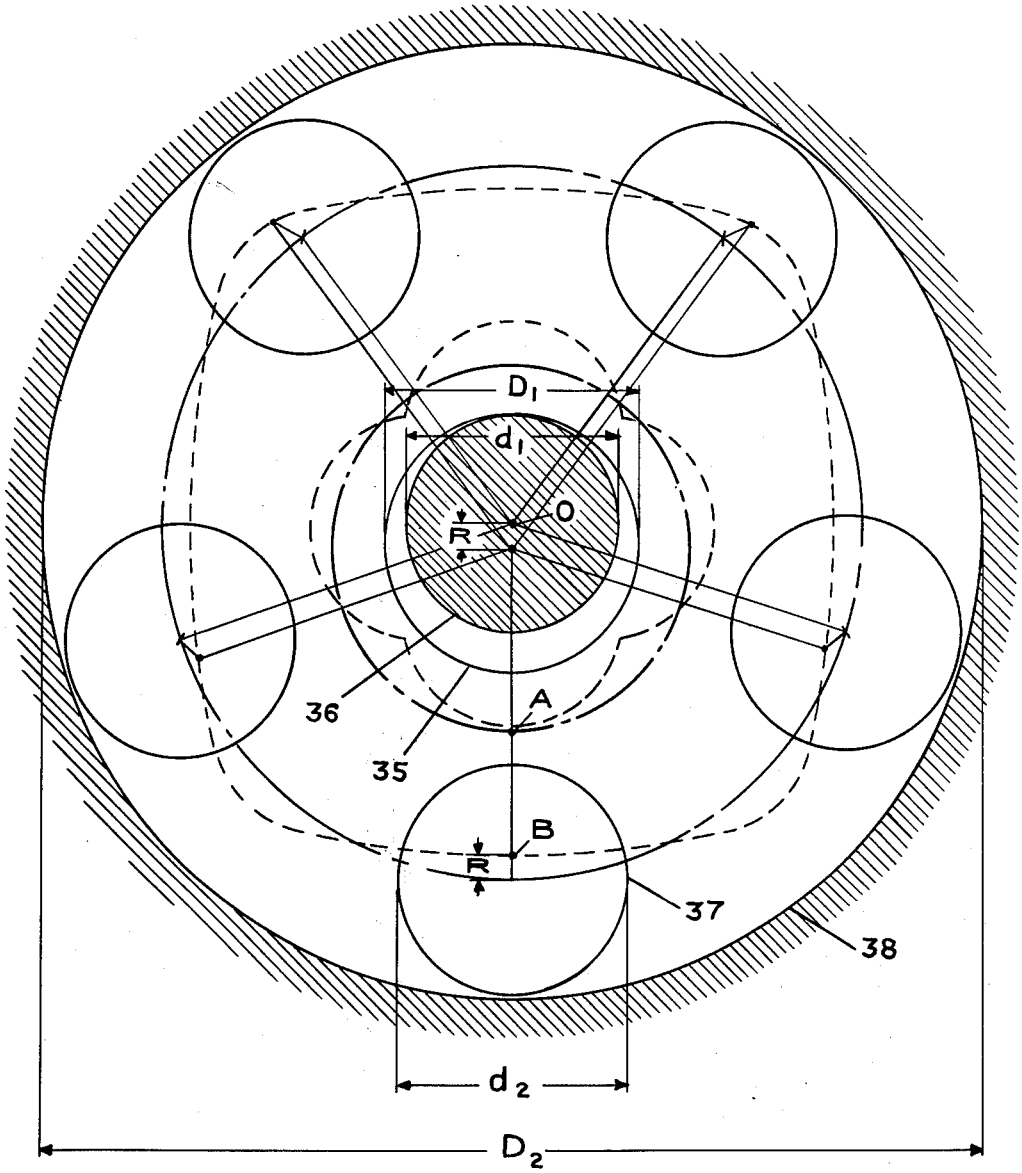

The invention will be described in more detail with reference to the accompanying drawings, in which FIG. 1 shows a longitudinal section through a five-cylinder, four-stroke engine, FIG. 2 shows a cross section through the same engine, through the centre of the piston system, FIG. 3 shows a section parallel to the one shown in the foregoing figure at the dividing surface between the rotor and the end of the engine housing, FIG. 4 shows in a longitudinal section an alternative embodiment of the planetary piston system, and FIG. 5 shows schematically the trochoid curves described by the rotor and the pistons.

FIGS. 1, 2, and 3 show a five-cylinder, four-stroke engine. A cylinder block in the form of a rotor 1 with five radial cylinders and with plane-parallel sides is eccentrically supported on a main shaft 2 which, in turn, is rotatably supported in the walls 3 and 4 which, together with a connecting part 5 form a stationary engine housing. The rotor 1 and the part $2^1$ of the shaft 2 which form an eccentric bearing are counterbalanced with regard to the main shaft by means of counterweights 6 and 7. Furthermore, the rotation of the rotor 1 in relation to the engine housing 3, 4, 5 is mechanically guided, by an inner gear ring 8 fixed to the rotor 1 being in mesh with a gear 9 fixed to the wall 3 of the engine housing. The inner part of each cylinder is made in the form of a compression chamber 10 with gas exchanging ports towards the flat sides of the rotor. The gas exchanging ports are provided with flat seals 11 and 12, which slide against a surface ground part of the respective wall. An inner circular flat seal 13 and an outer circular flat seal 14 which slide against the flat surfaces of the rotor seal off the gas exchanging system from the other parts of the engine housing. In addition to the bearing for the main shaft 2, the wall 3 comprises two intake ports 15 and the seat for the spark plug 16, as well as channels 17 for cooling of the wall and the coolant intake 18 for the rotor.

The opposite wall 4, in addition to the bearing for the main shaft 2, comprises exhaust ports 19 and cooling channels 20 with outlets 21 for the coolant for the rotor.

In each cylinder a piston 22 runs, which is rotatably supported at its centre of gravity on a secondary shaft 23 which has the same eccentricity as the eccenter of the main shaft. The piston and eccenter are counterbalanced by means of the counterweights 24 which are fixed to two parts of the shaft 23 which are formed into runner wheels 25. Gears 26 are concentric with and fixed to the runner wheels 25. The secondary shafts roll on the races 27 which are fixed to the engine housing 5 and are provided with an inner gear ring 28. Two rings 29 attached to the ends of the shaft and coacting with recesses in the walls 3 and 4 prevent the secondary shafts from leaving the races 27.

FIG. 4 shows an alternative arrangement of the piston system. The pistons 39 are rotatably supported on eccentric secondary shafts 30 which, in turn, are rotatably supported in a circular holder 31 which is rotatably supported in the respective wall, concentric with the main shaft 2. The eccenters are counterbalanced by means of counterweights 32. A gear wheel fixed to the shaft 30 is in mesh with a stationary inner gear ring 34. As the holder 31 fixes the distance between the secondary shafts, the pistons will mechanically guide the movement of the rotor in relation to the stationary system. The inner gear ring 8 on the rotor and the fixed gear wheel 9 coacting with it, in the embodiment shown in FIG. 1, will thereby become superfluous.

The kinematics of the engine will be described in the following with reference to FIG. 5. If the inner gear wheel 35, which is fixed to the rotor, is assumed to have the pitch diameter $D_1$ and the fixed gear wheel in mesh has the pitch diameter $d_1$ the eccentricity of the rotor with regard to the centre of rotation O of the main shaft will of necessity be equal to $(D_1 - d_1):2$. When the main shaft rotates, the inner gear wheel 35 rolls against the fixed gear whee 36, and an arbitrary point A on the rotor then describes an epitrochoid. If $d_1:(D_1 - d_1)$ is an integer $m$, the trochoid will be a closed curve, i.e. the point A recurring after one revolution in the same epitrochoid, which will have $m$ lobes. On the rotor, at the same distance from the centre as A, there are further $m$ points which describe exactly the same epitrochoid as A, i.e. a total of $m + 1$ points. In order for the point A to complete one revolution in relation to the fixed system, the main shaft must complete $m + 1$ turns. The curve shown as an example in FIG. 5 will arise if $m = 4$, i.e. the diameter relation $d_1 : D_1 = 4:5$ and is representative for a five-cylinder engine which runs through 2

× 4 strokes per cylinder per 5 revolutions of the main shaft.

According to the invention, the pistons are eccentrically supported on secondary shafts, which have a planetary movement around the main shaft. If the gear wheels of the secondary shafts have the pitch diameter $d_2$ and roll against the inner gear ring 38 with the pitch diameter $D_2$ a point B on the radius R will describe a hypotrochoid which will be closed if $D_2 : d_2 = n$, where $n$ is an integer. If $n = m$ the point B will describe a hypotrochoid with the same number of lobes as the epitrochoid described by A. If moreover $R = (D_1 - d_1) : 2$ i.e. the eccentricity of the pistons with regard to the secondary shafts is equal to the eccentricity of the rotor with regard to the main shaft, the hypotrochoid described by the point B will have the same amplitude as the epitrochoid described by the point A. If the secondary shafts are phased in so that the points A and B are on the same radius OAB and B reaches its outermost position at the same time as A reaches its innermost position and vice versa, the distance between A and B will vary sinusoidally with an amplitude which is 2R. The point B completes one revolution in relation to the fixed system for $m + 1$ revolutions of the main shaft. At a constant speed of the main shaft, the secondary shafts circle with a constant speed in relation to the fixed system which is $m + 1$ times lower.

I claim:

1. In a rotary-block engine comprising a rotatable cylinder block having a plurality of radially mounted cylinders therein, a main shaft supporting said cylinder block and rotatable with said cylinder block, each of said plurality of cylinders having a reciprocating piston mounted therein which is moved in response to the explosion of a combustion gas in the combustion chamber of the cylinder, a plurality of secondary shafts, one for each of said plurality of cylinders, for rotatably mounting thereon the plurality of reciprocating pistons, and a stationary housing rotatably mounting therein said main shaft and said cylinder block, wherein the improvement comprises: said main shaft being an eccentric shaft and mounting said cylinder block on the eccentric thereof so that a point on said cylinder block traces a path in the form of an epitrochoid, each of said plurality of secondary shafts also being an eccentric shaft, each of said pistons being mounted on the eccentric of its respective secondary shaft so that a point on the piston will trace a path in the form of a hypotrochoid, means for fixing the spacing between said main shaft and said cylinder block and radially fixing the plurality of secondary shafts with respect to said main shaft, each of said secondary shafts rotating at a speed less than the speed of said main shaft and each of said pistons having a speed about said main shaft that is also less than the speed of said main shaft, and means for controlling the movement of said pistons so that they move in said hypotrochoid manner.

2. The improvement according to claim 1, wherein said speed of each of said pistons is equal to the speed of said main shaft divided by the number of said plurality of cylinders.

3. The improvement according to claim 1, wherein said means for controlling the movement of said pistons comprises a plurality of gear wheels, each gear wheel being affixed to one end of a secondary shaft, and a stationary gear wheel formed on the inner circumferential surface of said stationary housing, said plurality of gear wheels being in meshing engagement with said stationary gear wheel of said housing and moved therealong in response to the rotation of said secondary shafts by said pistons.

4. The improvement according to claim 3, wherein said means for fixing the spacing between said main shaft and said cylinder block comprises an outer gear wheel formed on the inner circumferential surface of one end of said cylinder block, and an inner stationary gear wheel affixed to said stationary housing, said inner and outer gear wheels being in meshing engagement, said inner stationary gear wheel being mounted about a portion of said stationary housing encompassing a portion of said main shaft, so that as said main shaft and said cylinder block rotate said outer gear rotates about said inner stationary gear with a portion of said outer gear teeth being in engagement with a portion of said inner stationary gear wheel at any one time.

5. The improvement according to claim 4, wherein said means for radially fixing the plurality of secondary shafts with respect to said main shaft comprises a first and a second circular grove formed in the side walls of said stationary housing, each of said secondary shafts having a first end having a first projection thereon for running in said first circular groove, and a second end having a second projection thereon for running in said second circular groove, whereby said secondary shafts are held in place but allowed to rotate by said first and second circular grooves.

6. The improvement according to claim 1, wherein said means for fixing the spacing between said main shaft and said cylinder block and radially fixing the plurality of secondary shafts with respect to said main shaft comprises a plurality of rotatable holders rotatably mounted about said main shaft, each of said rotatable holders having means for rotatably mounting therein one of said plurality of secondary shafts.

7. The improvement according to claim 6, wherein said means for controlling the movement of said pistons comprises a plurality of gear wheels, each gear wheel being affixed to one end of a secondary shaft, and a stationary gear wheel formed on the inner circumferential surface of said stationary housing, said plurality of gear wheels being in meshing engagement with said stationary gear wheel of said housing and moved theralong in response to the rotation of said secondary shafts by said pistons.

* * * * *